US008712063B2

(12) United States Patent
Roeck et al.

(10) Patent No.: US 8,712,063 B2
(45) Date of Patent: Apr. 29, 2014

(54) SYNCHRONIZATION OF SOUND GENERATED IN BINAURAL HEARING SYSTEM

(75) Inventors: Hans-Ueli Roeck, Hombrechtikon (CH); Raoul Glatt, Zurich (CH); Micha Knaus, Jona (CH); Rolf Laich, Ruti (CH)

(73) Assignee: Phonak AG, Stafa (CH)

( * ) Notice: Subject to any disclaimer, the term of this patent is extended or adjusted under 35 U.S.C. 154(b) by 1962 days.

(21) Appl. No.: 11/311,787

(22) Filed: Dec. 19, 2005

(65) Prior Publication Data

US 2007/0140506 A1 Jun. 21, 2007

(51) Int. Cl.
*H04R 25/00* (2006.01)

(52) U.S. Cl.
USPC ..... 381/23.1; 381/312; 381/315

(58) Field of Classification Search
USPC ..... 381/315
See application file for complete search history.

(56) References Cited

U.S. PATENT DOCUMENTS

| | | | | |
|---|---|---|---|---|
| 6,549,633 | B1 * | 4/2003 | Westermann | 381/312 |
| 7,561,708 | B2 * | 7/2009 | Rohrlein | 381/315 |
| 2002/0013613 | A1 | 1/2002 | Haller et al. | |

FOREIGN PATENT DOCUMENTS

| | | | | |
|---|---|---|---|---|
| DE | 10 2004 035 046 | | 7/2005 | |
| DE | 10 2004 035 256 | B3 | 9/2005 | |
| EP | 0 557 847 | | 2/1993 | |
| EP | 0 941 014 | A2 | 9/1999 | |
| EP | 941014 | A2 * | 9/1999 | H04R 25/00 |
| WO | 01/30127 | | 5/2001 | |

* cited by examiner

*Primary Examiner* — Matthew Eason
(74) *Attorney, Agent, or Firm* — Peane & Gordon, LLP

(57) ABSTRACT

The binaural hearing system comprises a first hearing device and a second hearing device, each comprising an output transducer for converting audio signals into signals to be perceived by a user of the hearing system. A communication link interconnects the first and second hearing devices. A sound generator comprised in the first hearing device generates first audio signals. The first hearing device is adapted to transmit the first audio signals to the second hearing device via the communication link. Through the transmission of the generated first audio signals, it is possible to achieve a predictable latency for the perception of the first audio signals by the user's two ears.

12 Claims, 2 Drawing Sheets

SYNCHRONIZATION OF SOUND GENERATED IN BINAURAL HEARING SYSTEM

TECHNICAL FIELD

The invention relates to a binaural hearing system comprising two hearing devices, one for each ear of a user of the hearing system, and to a method of operating such a hearing system and a method of synchronization in such a hearing system. Such a hearing system is a linked pair of hearing devices. The hearing devices can be hearing aids, worn in or near the ear or implanted, headphones, earphones, hearing protection devices, communication devices or the like.

BACKGROUND OF THE INVENTION

From EP 0 557 847 B1 a monaural hearing device is known, which comprises a signal emission device by means of which a user of the hearing device can be informed that a particular setting of the hearing device has been selected.

From WO 01/30127 A2 a monaural hearing device is known, which allows to play user-defined sequences for acknowledging an action that has been carried out on the hearing device.

From US 2002/0131613 A1 a binaural hearing system is known, in which audio signals obtained from digitizing output signals of a microphone of the hearing system are transmitted from one hearing device of the system to the other hearing device of the system via a communication link. Furthermore, control signals can be transmitted via said communication link. Such control signals can, e.g., be signals for controlling a signal processor of a hearing device, or signals by means of which a first of the two hearing devices acknowledges to the second hearing device that is has received a control signal that was transmitted from the second hearing device to the first hearing device. The two hearing device are synchronized by a controlled time-multiplexer unit, which is operated by a respective time control unit, wherein the two time control units are synchronized via said communication link.

From DE 10 2004 035 046 A1 binaural hearing systems are known, which provide for "virtual sound sources" in the sense that system-generated sounds can be perceived by a user of the system as if they were generated in different locations near the user. Said DE 10 2004 035 046 A1 does not disclose, how to achieve the time synchronization (and timing accuracy) between the signals to be perceived by the user with his left and his right ear, respectively, which is necessary in order to predictably achieve such a virtual sound source effect.

SUMMARY OF THE INVENTION

A goal of the invention is, to create a binaural hearing system and a method of operating a hearing system and a method of synchronization in a hearing system with enhanced possibilities for giving the user of the hearing system the impression that he perceives signals from a certain location or certain direction.

One object of the invention is to provide for a binaural hearing system and a method of operating a hearing system and a method of synchronization in a hearing system with improved possibilities for synchronizing the perception of sound in the user's left and the right ear.

Another object of the invention is to provide for a binaural hearing system and a method of operating a hearing system and a method of synchronization in a hearing system providing for a precisely predictable time difference between the user's perception of system-generated signals in the user's left and right ears.

These objects are achieved by a binaural hearing system and by a method for operating a hearing system and by a method of synchronization in a hearing system according to the patent claims.

The binaural hearing system comprises

- a first hearing device and a second hearing device, each comprising an output transducer for converting audio signals into signals to be perceived by a user of the hearing system;
- a communication link interconnecting said first and said second hearing device; and
- a sound generator comprised in said first hearing device for generating first audio signals;

wherein first hearing device is adapted to transmitting said first audio signals to said second hearing device via said communication link.

Through this, it is possible to achieve a rather precisely predictable time difference between the perception of signals obtained from said first audio signals in the user's left and right ears.

Today, software-controlled digital hearing devices are widely used. Accordingly, commands of such a hearing device software are generated and executed along clocked threads with a certain tick period, which determines discrete points in time at which commands are executed. Such a tick period is typically of the order of 10 ms (some milliseconds to some ten milliseconds). In the case of a hearing system with two hearing devices, the threads in the two hearing devices are usually not in phase and do usually not even have a constant phase relation, and even the tick periods in the two hearing devices are usually somewhat different. This may be due to various reasons: the two hearing devices are switched on at different times; the booting of the hearing device controlling software does not take exactly the same amount of time in both hearing devices; the clock oscillators in the two hearing devices show (different) drift; the clock oscillators in the two hearing devices are (slightly) differently tuned.

Accordingly, there will always be a jitter of the order of some or several milliseconds between "synchronized" commands in the two hearing devices, unless great effort is taken to create a stable phase relation between the threads of the control software of the two hearing devices. Note that such a jitter means a practically randomly occuring time difference between left and right hearing device.

Thus, signals perceived by a user will, if such a jitter is present, randomly appear to arrive from random directions, to contain echo, or to stutter.

In addition, particular tasks, like hearing-device-internal sound generation, may run along threads which are different from the thread of other parts of the hearing device software. The thread may even have a different tick period than the hearing device control software.

All this makes it difficult or impossible to provide a hearing system user with signals (typically sound), so that these signals are perceived by the user as coming from a predictable direction. For achieving such an effect, an accuracy of some or some ten microseconds (μs) (at most maybe about 50 μs to 100 μs) is necessary, since the whole range spanning from signals being perceived as stemming from straight ahead or from the back to signals being perceived as stemming from the very left or very right of the user ranges, in terms of time delays between the left and the right side, from 0 μs to about 600 μs or 650 μs. A jitter of more than 0.5 ms or even more than 1 ms is therefore not acceptable.

On the other hand, some types of processes within a hearing device are deterministic (within the desired timing accuracy), e.g., signal processing, conversion, amplification or transmission of data or signals from one hearing device to the other. The time required for such processes can be determined in advance; accordingly, they do not contribute to a (random) jitter.

Accordingly, for signals, which shall be perceived by the user's ears with a minimal time jitter (of the order of magnitude of 10 μs) between left and right, only deterministic processes shall take place in each of the hearing devices after a highly synchronized origin of the signals (no jitter or below about 20 μs). Such an origin can be the generation of said signals in only one of the hearing devices.

Only one stream of audio signals (acoustic sound message data) is generated (issued), by only one of the two hearing devices, and this stream is delivered, via said communication link, to the other hearing device, in which it may undergo amplification and other processing and finally presentation to the user with near-negligible latency with respect to the contralateral side. In both hearing devices, equal or similar processing of the audio signals may take place, and, if required, pre-determinable delays between the two sides may be accomplished for by introducing an according delay on the faster side.

Thus, random delays from a lack of (precise) synchronization between the two sides are effectively avoided.

An audio signal (or sound message) originating from a single source is presented to the user with a deterministic delay between the two sides.

Typically, the invention can be used in conjunction with acknowledge signals (or other sound messages) as the signals to be perceived by the hearing device user.

Acknowledge sounds, also called feedback sounds, are played to the user upon a change in the hearing device's function, e.g., when the user changes the loudness (volume) or another setting or program of one or both hearing devices, or when some other user's manipulation shall be acknowledged, or when the hearing device by itself takes an action, e.g., by making a change, e.g., if, in the case of a hearing aid, the hearing aid chooses, in dependence of the acoustical environment, a different hearing program (frequency-volume settings and the like), or when the hearing device user shall be informed that a hearing device's battery is low.

Said signals to be perceived by the user are often acoustic signals (sound waves), but may be other signals as well, e.g., in the case of implanted hearing devices. The hearing devices' output transducers can therefore be electro-to-mechanical converters (loudspeakers) or others, e.g., electrical-to-electrical converters.

Said audio signals are usually electrical signals, analogue and/or digital.

Said communication link may be wireless (typically electromagnetically; e.g., in the radio frequency range via frequency modulation, or Ultra-Wide-Band communication UWB), or wire-bound. Said communication link allows for communication at least from said first hearing device to said second hearing device, but usually allows for bidirectional communication.

Said communication link may involve at least one transmitter comprised in said first hearing device and at least one receiver comprised in said second hearing device. It may, in addition, comprise at least one receiver comprised in said first hearing device and at least one transmitter comprised in said second hearing device.

Said sound generator may be implemented in software or (partially) in form of hardware.

Typically, said first and said second hearing devices each comprise an input transducer for receiving incoming signals and for converting said incoming signals into audio signals. Typically, such incoming signals are incoming sound, and said input transducers are mechanical-to-electrical converters (microphones), but converters receiving electromagnetical waves and converting these into audio signals are also possible (e.g., in case of a telephone coil or reception of a remote microphone signal via a frequency modulation -FM-receiver).

Typically, at least one of said hearing devices, usually both (said first and said second hearing devices), each comprise a signal processor for processing audio signals.

In one embodiment, the system comprises, comprised in said first hearing device, a first sound memory, which comprises a first set of data, which describe audio signals (in particular, first audio signals), and, comprised in said second hearing device, a second sound memory, which comprises a second set of data, which describe audio signals, wherein said first and second sets of data are substantially different from each other. This way, both hearing devices contain data describing (different) audio signals, and, accordingly, the required storage space in each hearing device can be (up to) halved (with respect to storing the same data in each hearing device). If, e.g., the user makes, at the second hearing device, a change, which is to be acknowledged (on both sides), and the appropriate acknowledge sound is stored in the second hearing device, and the data describing the corresponding audio signals can be transmitted to the first hearing device, the sound generator can produce the corresponding audio signal, which finally can be transmitted to the second hearing device and transduced into signals acknowledging said manipulation (on both sides). In the case that said data describe acknowledge sounds, the data sets can be considered first and second sets of acknowledge sound descriptions (or representations).

In said data of said first and second sets, audio signals may be described, e.g., in a parametrized form (e.g., as a frequency to be played and a time for which it is to be played), or in a sampled form (e.g., compressed, like in MP3 format).

In one embodiment, at least one of said first and said second hearing devices comprises a storage unit containing information on the contents of said first sound memory and/or of said second sound memory. By means of such a storage unit, it can be found out, without any communication between the first and the second hearing devices, whether data describing a desired sound are stored in the first or in the second hearing device. It is, e.g., possible to have in said storage unit a list of the contents of the first and of the second sound memory indicating where to find data of desired audio signals. And it is also possible to have in said storage unit a list of the contents of the sound memory of only one hearing device (which may be the hearing device containing said storage unit, or the other hearing device). In the latter case, the existence and not-existence in the list can indicate where (i.e., in which hearing device) data of the desired audio signals can be found.

The storage unit may be a table or a look-up table.

Accordingly, said storage unit may be considered to contain information on whether audio signals to be sent to said output transducers can be obtained from data contained in said first sound memory (i.e., in said first set of data) or from data contained in said second sound memory (i.e., in said second set of data).

In one embodiment, the system furthermore comprises a second sound generator for generating second audio signals, which is comprised in said second hearing device, and wherein said second hearing device is adapted to transmitting said second audio signals to said first hearing device via said communication link. This way, both hearing devices comprise a sound generator, and sound generated in either sound generator may be transmitted to the other hearing device.

Said first audio signals, and also said second audio signals, may comprise or be acknowledge sound signals. When only (sufficiently) deterministic processes are involved after the sound generation, the corresponding time delays in each hearing device can be calculated in advance, and corresponding delays may be used in order to let the user perceive the sounds in each ear with a well-defined time delay.

The method for operating a hearing system comprising a first and a second hearing device and a communication link connecting the two hearing devices comprises the steps of generating first audio signals in said first hearing device;

transmitting said first audio signals to said second hearing device via said communication link; and converting, in each of the two hearing devices, said first audio signals into signals to be perceived by a user of the hearing system.

The features of the method of synchronization in a hearing system corresponds to the features of the method for operating a hearing system. The method allows for a synchronized perception of signals to be perceived by the user in each ear.

The method may furthermore comprise the steps of generating second audio signals in said second hearing device; and transmitting said second audio signals to said first hearing device via said communication link.

In another method, wherein said first hearing device comprises a first sound memory, which comprises a first set of data, which describe audio signals (first and/or second audio signals), and said second hearing device comprises a second sound memory, which comprises a second set of data, which describe audio signals (first and/or second audio signals), and wherein said first and second sets of data are substantially different from each other, further comprises the step of transmitting data from said second sound memory via said communication link to said first hearing device.

This method, wherein at least one of said first and said second hearing devices comprises a storage unit containing information on the contents of said first sound memory and (or and/or) of said second sound memory, may further comprise the steps of retrieving from said storage unit the information whether audio signals to be converted into signals to be perceived by a user of the hearing system are to be obtained from data contained in said first sound memory or from data contained in said second sound memory;

retrieving, from the appropriate sound memory, data describing the appropriate audio signals.

If said sound memory data are contained in that one sound memory, which is located in that one hearing device, which does not comprise said storage unit, a command (control signal) can be transmitted (via said communication link) to the other hearing device (which comprises the sound memory comprising said data) in order to retrieve the desired sound memory data.

The advantages of the methods correspond to the advantages of corresponding systems.

Further preferred embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. Generally, alike or alike-functioning parts are given the same or similar reference symbols. The described embodiments are meant as examples and shall not confine the invention.

DETAILED DESCRIPTION OF THE INVENTION

Figure 1:
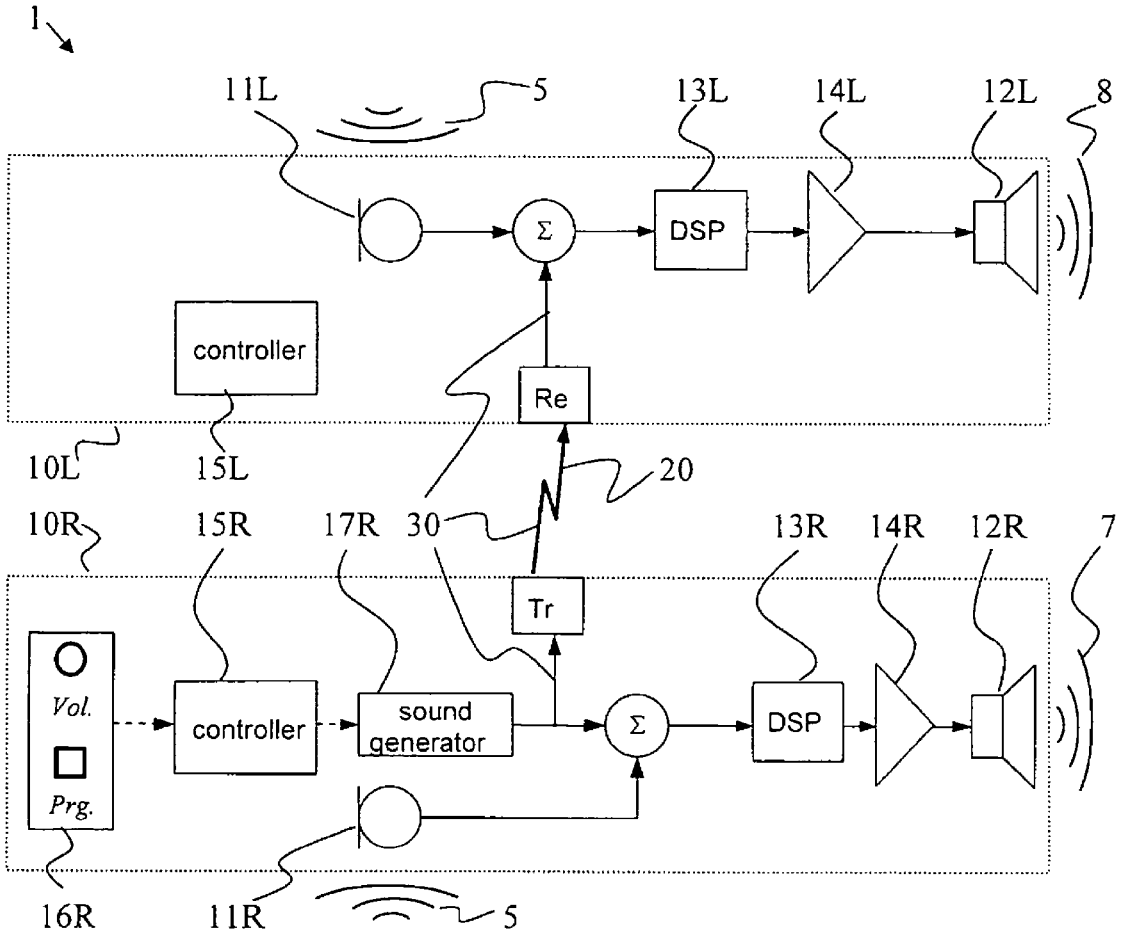
FIG. 1 a schematic diagram of a hearing system.
Figure 2:
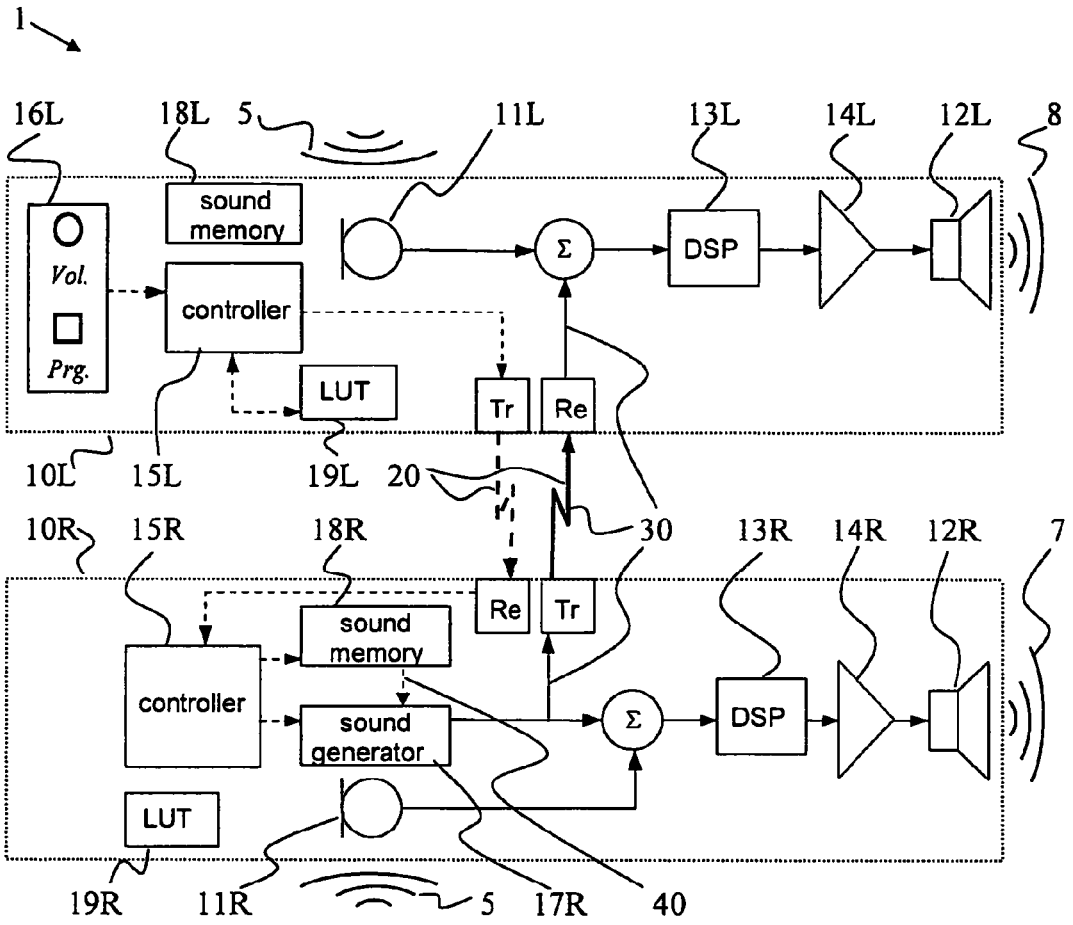
FIG. 2 a schematic diagram of a hearing system.

FIGS. 1 and 2 show schematic diagrams of hearing systems 1. A hearing system 1 comprises two hearing devices 10L and 10R, which may be similarly or identically structured. The hearing device 10L of FIGS. 1 and 2 may comprise some more elements, in particular such, which are only drawn in the first hearing device 10R.

In the FIGS. 1 and 2, audio signals (audio data streams) are drawn as solid arrows; control signals or data are represented by dashed arrows. Not all possible signal flows are indicated, but only some, which are required to explain the invention.

The hearing devices 10R,10L comprise controllers or control softwares 15L,15R. For normal operation, the hearing devices 10L,10R comprise input transducers 11L,11R, typically microphones, which convert incoming sound 5 into audio signals (analogue and/or digital electrical signals). These audio signals may be processed in signal processors 13L,13R, preferably digital signal processors (DSP), and are possibly amplified in amplifiers 14L,14R before being converted into signals 7,8 to be perceived by a user of the hearing system 1 by output transducers 12L,12R, typically loudspeakers.

In FIG. 1, a user interface 16R, a sound generator 17R and a transmitter Tr of hearing device 10R are drawn. Hearing device 10L comprises a receiver Re.

Although drawn as separate units, the DSP 13R and the amplifier 14R may be integrated within the same software or electrical unit. In addition, also the controller or control software 15R may be integrally formed with DSP 13R and/or amplifier 14R. The hearing device controlling software 15L, 15R may be implemented in a separate processor, but does not have to. The same applies for the corresponding elements of the hearing device 10L.

In FIG. 1, it is sketched, how a concurrent or (practically) jitter-free perception by the user of an acknowledge sound, e.g. upon a volume change in hearing device 10R, can be achieved.

The user manipulates the user interface 16R in order to change the volume (loudness) of signals 7,8 he perceives (typically the loudness in both hearing devices shall be changed). This generates a control signal, whereupon the sound generator 17R is instructed by the controller 15R to generate an appropriate sound message (acknowledge signal), which is referred to as first audio signals 30. The first audio signals 30 are, on the one hand, fed to the output transducer 12R (e.g., via DSP 13R and amplifier 14R, or directly, or in between the two) to be converted into signals 7 to be perceived by the user, and on the other hand, fed to the transmitter Tr of the hearing device 10R. Instead of adding the first audio signals 30 to audio signals obtained from incoming sound 5, they may as well replace those audio signals.

By means of a communication link 20 involving the transmitter Tr of hearing device 10R and the receiver Re of hearing device 10L, the first audio signals 30 are made available in the hearing device 10L, where they are, in analogy to the hearing device 10R, converted into signals 8 to be perceived by the user.

It is possible to foresee a delay unit in the signal path (at least in the hearing device 10R), which allows for compensating and/or introducing time delays between the two hearing devices 10L,10R. For example, if processing (and amplifying) steps are the same for the first audio signals 30 in both hearing devices 10L,10R, the only step causing a time delay between the two hearing devices is the transmission of the first audio signals 30 via the communication link 20. For encoding (in transmitter Tr), transmitting and decoding (in receiver Re), a pre-determinable delay of the order of, e.g., some milliseconds is introduced, which may have a jitter of the order of some microseconds to 10 μs or 30 μs. This delay can by compensated by such a delay unit. And additional delays between both sides (typically of the order of some 10 μs to some 100 μs) can be willingly introduced in order to simulate that the perceived signal 7,8 originates from a certain (predetermined) direction.

Of course, in order to improve such a simulation (virtual sound source), the (first) audio signals may be processed using Head-Related Transfer Functions (HRTF) in the sense that not only interaural time differences (ITD) are applied as described above, but also interaural level differences (ILD), or, more generally speaking, frequency dependent interaural amplitude and phase differences.

FIG. 2 shows, in the manner of FIG. 1, a schematic diagram of another hearing system 1. The embodiment is similar to the one of FIG. 1, and mainly the additional or different features will be described.

Both hearing devices 10L,10R comprise a sound memory 18L,18R, in each of which a set of data describing audio signals (e.g., acknowledge sounds and/or speech sounds) are contained. For example, the sound memory 18R may contain (data describing) acknowledge sounds, which are to be played when the volume is increased, when the volume is decreased, or when the battery level is low, whereas in the sound memory 18L, (data describing) acknowledge sounds may be stored, which acknowledge a change from one hearing program to another hearing program.

Furthermore, both hearing devices 10L,10R contain storage units 19L,19R, by means of which the respective controller 15L,15R can find out, whether a desired audio signal is stored in the sound memory 18L of the hearing device 10L or in the sound memory 18R of hearing device 10R.

Both hearing devices comprise a transmitter Tr and a receiver Re each, thus enabling a bidirectional communication link 20.

In FIG. 2, it is sketched, how a concurrent or (practically) jitter-free perception by the user of an acknowledge sound, e.g. upon a volume change in hearing device 10L, can be achieved.

The user manipulates the second hearing device's user interface 16L. This is noted by the controller 15L. The controller checks the storage unit (table, LUT) 19L and finds out, that the appropriate acknowledge sound (first audio signals 30) is not stored in the sound memory 18L, but in the sound memory 18R of the contralateral hearing device 10R. Thereupon, a control signal is transmitted via the second hearing device's transmitter Tr and the first hearing device's receiver Re to the second hearing device's controller 15R. The controller 15R ensures that the requested data 40 representing (describing) the requested first audio signals 30 are loaded from the sound memory 18R and that the requested audio signals 30 are generated. The requested audio signals 30 are fed towards the output transducer 12R and, in addition, transmitted to the second hearing device 10L via the communication link 20, from where it is transmitted to the output transducer 12L Of course, also the second hearing device 10L may comprise a sound generator.

In conjunction with one sound memory or with sound memories 18L,18R, at least the following embodiments are possible:

- only the first hearing device 10R comprises a sound generator 17R, and only the first hearing device 10R comprises a sound memory 18R;
- only the first hearing device 10R comprises a sound generator 17R, and only the second hearing device 10L comprises a sound memory 18R (this requires always the transmission of data from hearing device 10L to hearing device 10R when a stored audio signal is to be played);
- only the first hearing device 10R comprises a sound generator 17R, and both hearing devices 10L,10R comprise a sound memory 18L,18R;
- both hearing devices 10L,10R comprise a sound generator 17L,17R, and only the first hearing device 10R comprises a sound memory 18R;
- both hearing devices 10L,10R comprise a sound generator 17L,17R, and both hearing devices 10L,10R comprise a sound memory 18L,18R.

Depending on where data are stored and where they are generated, data and/or audio signals have to be transmitted via the communication link 20.

It is possible to foresee a storage unit 19 in only one hearing device instead of in both.

Figure 3:
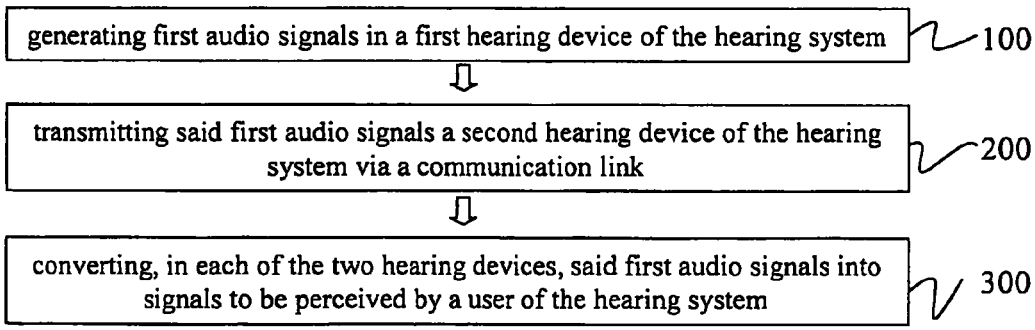
FIG. 3 a block diagram of a method of operating a hearing system.

FIG. 3 shows a block diagram of a simple method of operating a hearing system 1. The steps 100-300 are self-explaining.

The invention enables for a deterministic (predictable) latency and negligible jitter for signals to be perceived by the user's two ears.

The invention is particularly useful, when speech signals or more complex sounds are to be generated and presented to the user. The complexity of a sound may manifest in its (large) spectral content, its structure in time or rhythmic or percussive structure. Speech sounds may be used for guiding the user, informing the user and acknowledging events in the hearing system. Requirements for latency and jitter are less tough for simple sounds, like sine tones that fade in and fade out.

List of Reference Symbols

An appended "R" in a reference symbol indicates that the respective element is part of the first hearing device 10R; an appended "L" in a reference symbol indicates that the respective element is part of the second hearing device 10L.

1 hearing system, binaural hearing system
5 incoming sound, sound waves
7 signals to be perceived by a user of the hearing system (from the first hearing device 10R)
8 signals to be perceived by a user of the hearing system (from the second hearing device 10L)
10 hearing device
11 input transducer, microphone
12 output transducer, loudspeaker
13 signal processor, digital signal processor, DSP
14 amplifier
15 controller, control software, control part of hearing device software, hearing device controlling software
16 user interface
17 sound generator
18 sound memory

19 storage unit, table, lookup table
20 communication link
30 first audio signals
40 data describing first audio signals
100,200,300 steps
LUT lookup table
Tr transmitter
Re receiver

The invention claimed is:

1. Binaural hearing system comprising a first hearing device and a second hearing device, each comprising an output transducer for converting audio signals into signals to be perceived by a user of the hearing system;

a communication link interconnecting said first and said second hearing device;

an input transducer comprised in said first hearing device, for receiving incoming signals and for converting said incoming signals into audio signals; and a sound generator comprised in said first hearing device for generating further audio signals;

wherein said first hearing device is adapted to transmit said further audio signals to said second hearing device via said communication link, and wherein the sound generator is not connected to receive the audio signals from the input transducer.

2. System according to claim 1, wherein said second hearing device comprises another input transducer for receiving incoming signals, and for converting said incoming signals into audio signals.

3. System according to claim 1, comprising, a first sound memory, in said first hearing device, storing a first set of data, which describe audio signals, and, a second sound memory, in said second hearing device, storing a second set of data, which describe audio signals, wherein said first and second sets of data are substantially different from each other.

4. System according to claim 3, wherein at least one of said first and said second hearing devices comprises a storage unit containing information on the contents of said first sound memory and/or of said second sound memory.

5. System according to claim 1, furthermore comprising a second sound generator for generating additional audio signals, which is comprised in said second hearing device, and wherein said second hearing device is adapted to transmit said additional audio signals to said first hearing device via said communication link.

6. System according to claim 1, wherein said further audio signals comprise acknowledge sound signals.

7. System according to claim 5, wherein said additional audio signals comprise acknowledge sound signals.

8. Method for operating a hearing system comprising a first and a second hearing device and a communication link connecting the two hearing devices, said method comprising the steps of converting incoming signals into audio signals by an input transducer comprised in said first hearing device;

generating further audio signals by a sound generator comprised in said first hearing device, wherein the sound generator does not receive audio signals from the input transducer;

transmitting said further audio signals to said second hearing device via said communication link; and converting, in each of the two hearing devices, said further audio signals into signals to be perceived by a user of the hearing system.

9. Method according to claim 8, further comprising the steps of generating additional audio signals in said second hearing device; and transmitting said additional audio signals to said first hearing device via said communication link.

10. Method according to claim 8, wherein said first hearing device comprises a first sound memory, which stores a first set of data, which describe audio signals, and said second hearing device comprises a second sound memory, which stores a second set of such data, which describe audio signals, and wherein said first and second sets of data are substantially different from each other, further comprising the step of transmitting data from said second sound memory via said communication link to said first hearing device.

11. Method according to claim 10, wherein at least one of said first and said second hearing devices comprises a storage unit containing information on the contents of said first sound memory and/or of said second sound memory, further comprising the steps of retrieving from said storage unit the information whether audio signals to be converted into signals to be perceived by a user of the hearing system are to be obtained from data contained in said first sound memory or from data contained in said second sound memory;

retrieving from the appropriate sound memory data describing the appropriate audio signals.

12. Method of synchronization in a hearing system comprising a first and a second hearing device and a communication link connecting the two hearing devices, said method comprising the steps of converting incoming signals into audio signals by an input transducer comprised in said first hearing device;

generating further audio signals by a sound generator comprised in said first hearing device, wherein the sound generator does not receive audio signals from the input transducer;

transmitting said further audio signals to said second hearing device via said communication link; and converting, in each of the two hearing devices, said further audio signals into signals to be perceived by a user of the hearing system.

* * * * *